US008414096B2

(12) United States Patent
Yi et al.

(10) Patent No.: US 8,414,096 B2
(45) Date of Patent: Apr. 9, 2013

(54) SCANNER, IMAGE FORMING APPARATUS, AND MOTOR CONTROL METHOD OF SCANNER AND IMAGE FORMING APPARATUS

(75) Inventors: Jong-hyon Yi, Yongin-si (KR); Dane Baang, Suwon-si (KR); George Chiu, West Lafayette (IN); Moeed Mukhtar, West Lafayette (IN)

(73) Assignees: Samsung Electronics Co., Ltd, Suwon-si (KR); Purdue Research Foundation, West Lafayette, IN (US)

( * ) Notice: Subject to any disclaimer, the term of this patent is extended or adjusted under 35 U.S.C. 154(b) by 862 days.

(21) Appl. No.: 12/472,573

(22) Filed: May 27, 2009

(65) Prior Publication Data

US 2010/0002032 A1 Jan. 7, 2010

(30) Foreign Application Priority Data

Jul. 7, 2008 (KR) ..... 2008-65713

(51) Int. Cl.
*B41J 29/38* (2006.01)

(52) U.S. Cl.
USPC ..... 347/5; 347/9; 358/474

(58) Field of Classification Search ..... 358/474; 347/5, 9, 16, 19
See application file for complete search history.

(56) References Cited

U.S. PATENT DOCUMENTS

2007/0183003 A1* 8/2007 Bae ..... 358/474

FOREIGN PATENT DOCUMENTS

| | | |
|---|---|---|
| CN | 101014078 | 8/2007 |
| JP | 2004350191 | 12/2004 |
| KR | 10-0763943 | 10/2007 |

OTHER PUBLICATIONS

Korean Office Action Issued on Aug. 31, 2012 in KR application No. 10-2008-0065713.
Office Action issued in CN 200910135760.2 dated Feb. 1, 2013.

* cited by examiner

*Primary Examiner* — Lam S Nguyen
(74) *Attorney, Agent, or Firm* — Stanzione & Kim, LLP

(57) ABSTRACT

A scanner, an image forming apparatus and a motor control method of the scanner and the image forming apparatus. The motor control method includes scanning a test image formed on a document, calculating an actual speed of a scan head moved by the motor using the scanned test image, calculating a matrix representing a relation between a driving signal to drive the motor and the calculated actual speed of the scan head, and renewing the driving signal using an inverse matrix to the calculated matrix to correct the actual speed of the scan head.

25 Claims, 11 Drawing Sheets

FIG. 1
(CONVENTIONAL)
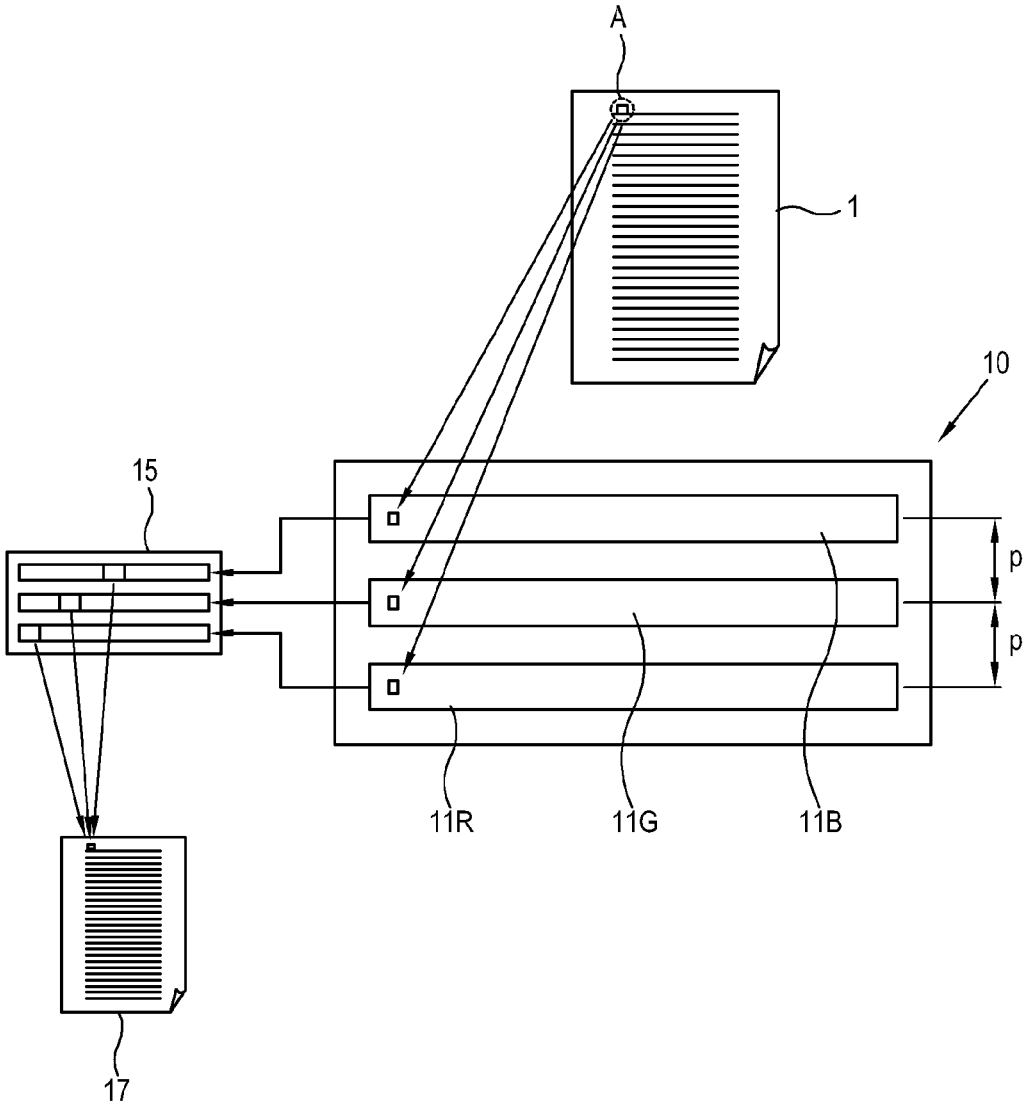

SCANNER, IMAGE FORMING APPARATUS, AND MOTOR CONTROL METHOD OF SCANNER AND IMAGE FORMING APPARATUS

CROSS-REFERENCE TO RELATED APPLICATIONS

This application claims priority from Korean Patent Application No. 10-2008-0065713, filed on Jul. 7, 2008 in the Korean Intellectual Property Office, the disclosure of which is incorporated herein by reference.

BACKGROUND OF THE INVENTION

1. Field of the Invention

The present general inventive concept relates to a scanner and an image forming apparatus which can correct a control signal for motor driving using a test image, and a motor control method of the scanner and the image forming apparatus.

2. Description of the Related Art

In general, a scanner reads image information from a document using light. To this end, the scanner includes a sensor unit for reading the image information from the document. The sensor unit has a plurality of sensors arranged in a row for color image scanning.

FIG. 1 illustrates a conventional color sensor unit for color image scanning. Referring to FIG. 1, the sensor unit 10 includes color image sensors 11R, 11G and 11B which are spaced from each other at a predetermined interval 'p'. Color filters are arranged above the respective color image sensors 11R, 11G and 11B, and receive color images reflected from the document. For example, an original image in an area 'A' of a document 1 is separated into a plurality of color images and then image-formed by the image sensors 11R, 11G and 11B. In this way, color data for the area 'A' is separately generated and is separately stored in a memory buffer 15.

Then, the color data stored in the memory buffer 15 is combined to realize a scan image 17. In this respect, if a scanning speed is uniform, the plurality of color data read from the same area of the document is spaced from each other at the interval 'p' in the memory buffer. Then, the scanned image can be re-formed by relatively moving the color data by the interval 'p' to be superimposed.

However, when driving a scan head through a driving part, it is in practice difficult to drive the scan head at a uniform speed. In particularly, in the case that a stepping motor is employed as the driving part, since the stepping motor does not include an encoder, a moving amount of the scan head cannot be fed back, and thus, it is difficult to determine whether or not the scan head moves at a uniform speed.

Due to the above structural features of the driving part, fluctuation in a speed of the scan head occurs, and thereby results in a color registration error in a scanned image.

This problem is caused by the fact that the original image is not directly captured at the same time and color image sensors for extracting color image data are spaced from each other at the interval 'p'. That is, when the speed of the scan head fluctuates, a relative interval between the color data becomes different from the predetermined interval 'p', and thus, the color registration error can occur.

The color registration error may occur in an inkjet image forming apparatus. The inkjet image forming apparatus generally includes a motor and an inkjet head reciprocally moved by the motor to form a color image on a printing medium. The inkjet head includes a plurality of color ink cartridges spaced from each other.

Accordingly, when realizing a full color image by combining inks provided from the color ink cartridges, if the inkjet head is fluctuated, the relative interval between the color data is also fluctuated, to thereby cause the color registration error.

SUMMARY OF THE INVENTION

The present general inventive concept provides a scanner and an image forming apparatus which can reduce fluctuation generated in motor driving, and a motor control method of the scanner and the image forming apparatus.

Additional features and utilities of the present general inventive concept will be set forth in part in the description which follows and, in part, will be obvious from the description, or may be learned by practice of the present general inventive concept.

The foregoing and/or other features and utilities of the present general inventive concept can be achieved by providing a motor control method of a scanner, including scanning a test image formed on a document; calculating an actual speed of a scan head moved by the motor using the scanned test image, calculating a matrix representing a relation between a driving signal to drive the motor and the calculated actual speed of the scan head, and renewing the driving signal using an inverse matrix to the calculated matrix to correct the actual speed of the scan head.

The test image may include a plurality of patterns arranged at a uniform interval.

The calculating the actual speed of the scan head may include extracting connection components of the respective patterns from the scanned test image, and calculating an actual interval between the neighboring connection components in a moving direction of the scan head, wherein the actual speed of the scan head may be calculated by using an ideal interval and the actual interval between the connection components in the moving direction of the scan head and a predetermined ideal speed of the scan head.

The calculating the actual interval in the moving direction of the scan head may include generating a center profile of each connection component, and calculating an interval between the center profiles of the respective connection components in the moving direction of the scan head.

The matrix may have lower triangular Toeplitz Markov parameters.

The method may further include storing the renewed driving signal.

The motor may include a stepping motor.

The foregoing and/or other features and utilities of the present general inventive concept can be also achieved by providing a scanner including a scan head provided to reciprocally move with respect to a support for supporting a document and comprising a light emitting part and a sensor unit to read image information from light reflected from the document, a motor to drive the scan head, and a controller to control the motor with a driving signal, the driving signal being renewed by using a relation between the driving signal and an actual speed of the scan head moved according to the driving signal which is calculated by scanning a test image formed on the document.

The test image may include a plurality of patterns arranged at a uniform interval.

The actual speed of the scan head may be calculated by extracting connection components of the respective patterns from the scanned test image, calculating an interval between center profiles of the respective connection components in a moving direction of the scan head to calculate an actual interval between the neighboring connection components in the moving direction of the scan head using an ideal interval and the actual interval between the connection components in the moving direction of the scan head and a predetermined ideal speed of the scan head.

The relation between the driving signal and the actual speed of the scan head may be represented by a matrix, and the driving signal may be renewed using an inverse matrix to the matrix.

The matrix may have lower triangular Toeplitz Markov parameters.

The motor may include a stepping motor.

The foregoing and/or other features and utilities of the present general inventive concept can be also achieved by providing an image forming apparatus including a scanner as mentioned the above; and a printing unit to print an image on a printing medium.

The foregoing and/or other features and utilities of the present general inventive concept can be also achieved by providing a motor control method of an image forming apparatus comprising an inkjet head having a plurality of ink cartridges, and a motor to drive the inkjet head, the method including forming a test image corresponding to printing data on a printing medium by driving the motor to move the inkjet head, scanning the test image formed on the printing medium, calculating an actual speed of the inkjet head using the scanned test image, calculating a matrix representing a relation between a driving signal to drive the motor and the calculated actual speed of the inkjet head, and renewing the driving signal using an inverse matrix to the calculated matrix to correct the actual speed of the inkjet head.

The printing data may include a plurality of patterns arranged at a uniform interval.

The calculating the actual speed of the inkjet head may include extracting connection components of the respective patterns from the scanned test images, and calculating an actual interval between the neighboring connection components in a moving direction of the inkjet head, wherein the actual speed of the inkjet head may be calculated using an ideal interval and the actual interval between the connection components in the moving direction of the inkjet head and a predetermined ideal speed of the inkjet head.

The calculating the actual interval in the moving direction of the inkjet head may include generating a center profile of each connection component, and calculating an interval between the center profiles of the respective connection components in the moving direction of the inkjet head.

The matrix may have lower triangular Toeplitz Markov parameters.

The method may further include storing the renewed driving signal.

The motor may include a stepping motor.

The foregoing and/or other features and utilities of the present general inventive concept can be also achieved by providing an image forming apparatus including an inkjet head having a plurality of ink cartridges, a motor to drive the inkjet head, and a controller to control the motor with a driving signal and a renewed driving signal, the driving signal being renewed by forming a test image corresponding to printing data on a printing medium by driving the motor to move the inkjet head, and using a relation between the driving signal and an actual speed of the inkjet head which is calculated using the test image.

The printing data may include a plurality of patterns arranged at a uniform interval.

The actual speed of the inkjet head may be calculated by: extracting connection components of the respective patterns; calculating an interval between center profiles of the respective connection components in a moving direction of the inkjet head to calculate an actual interval between the neighboring connection components in the moving direction of the inkjet head; and using an ideal interval and the actual interval between the connection components in the moving direction of the inkjet head, and a predetermined ideal speed of the inkjet head.

The relation between the actual speed of the inkjet head and the driving signal may be represented by a matrix, and the driving signal may be renewed using an inverse matrix to the matrix.

The matrix may have lower triangular Toeplitz Markov parameters.

The motor may include a stepping motor.

The foregoing and/or other features and utilities aspects of the present general inventive concept can be also achieved by providing a method of controlling a motor in an image forming apparatus, the method including determining an actual speed of a head unit based on a test image, calculating a relationship of the actual speed and a driving signal of the head unit, and sending a corrected driving signal to the head unit determined according to the calculated relationship.

Determining the actual speed of the head unit may further include determining an actual interval between patterns on the test image, and calculating the actual speed according to the actual interval, an ideal interval, and an ideal speed.

The patterns on the test image may be at least one of linear patterns, square patterns, and circular patterns.

The relationship may be a matrix representing the relationship between the actual speed and the driving signal.

The corrected driving signal may be determined according to an inverse matrix of the matrix.

The corrected driving signal may correct the actual speed of the head unit.

The head unit may be one of a scan head and a print head.

BRIEF DESCRIPTION OF THE DRAWINGS

The above and/or other features and utilities of the present general inventive concept will become apparent and more readily appreciated from the following description of the exemplary embodiments, taken in conjunction with the accompanying drawings, in which:

FIG. 1 illustrates a conventional color sensor unit for color image scanning;

DETAILED DESCRIPTION OF THE PREFERRED EMBODIMENTS

Figure 2:
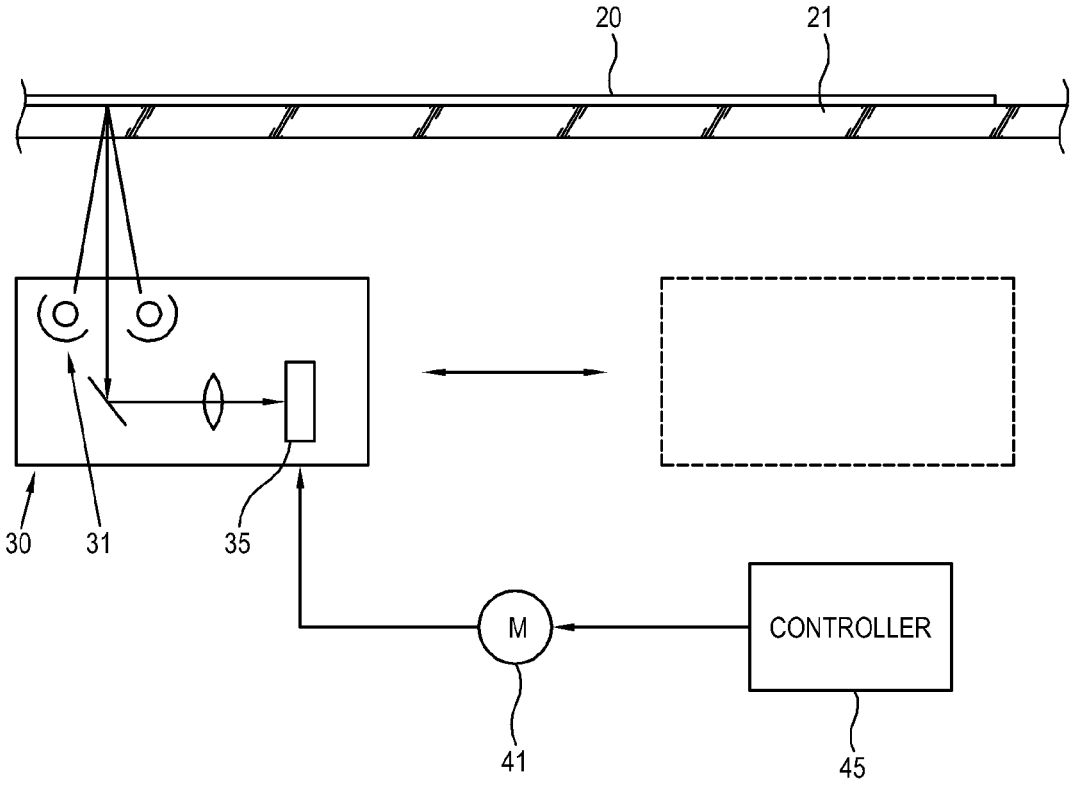
FIG. 2 illustrates a scanner according to an exemplary embodiment of the present general inventive concept.

Reference will now be made in detail to exemplary embodiments of the present general inventive concept, examples of which are illustrated in the accompanying drawings, wherein like reference numerals refer to like elements throughout. The exemplary embodiments are described below so as to explain the present general inventive concept by referring to the figures.

As shown in FIG. 2, a scanner according to an exemplary embodiment of the present general inventive concept includes a support 21 on which a document 20 is placed; a scan head 30 to reciprocally move with respect to the support 21; a motor 41 to drive the scan head 30; and a controller 45 to control the motor.

The scan head 30 includes a light emitting part 31 to emit light, and a sensor unit 35 to read image information from light reflected from the document 20. As shown in FIG. 2, the sensor unit 35 includes a plurality of color image sensors spaced from each other at a predetermined interval.

The motor 41 is driven by a driving signal from the controller 45 and reciprocally moves the scan head 30. The motor 41 may be provided as a stepping motor which rotates by a constant angle corresponding to the number of input pulses. Since the number of the input pulses and the rotational angle are proportional each other, the stepping motor can control positioning of an open loop.

The driving signal from the controller 45 is renewed using the relation between an actual speed of the scan head calculated by scanning a test image formed on the document 20 and the driving signal for driving the motor 41, which will be described in detail with reference to FIGS. 2 and 3.

Figure 3:
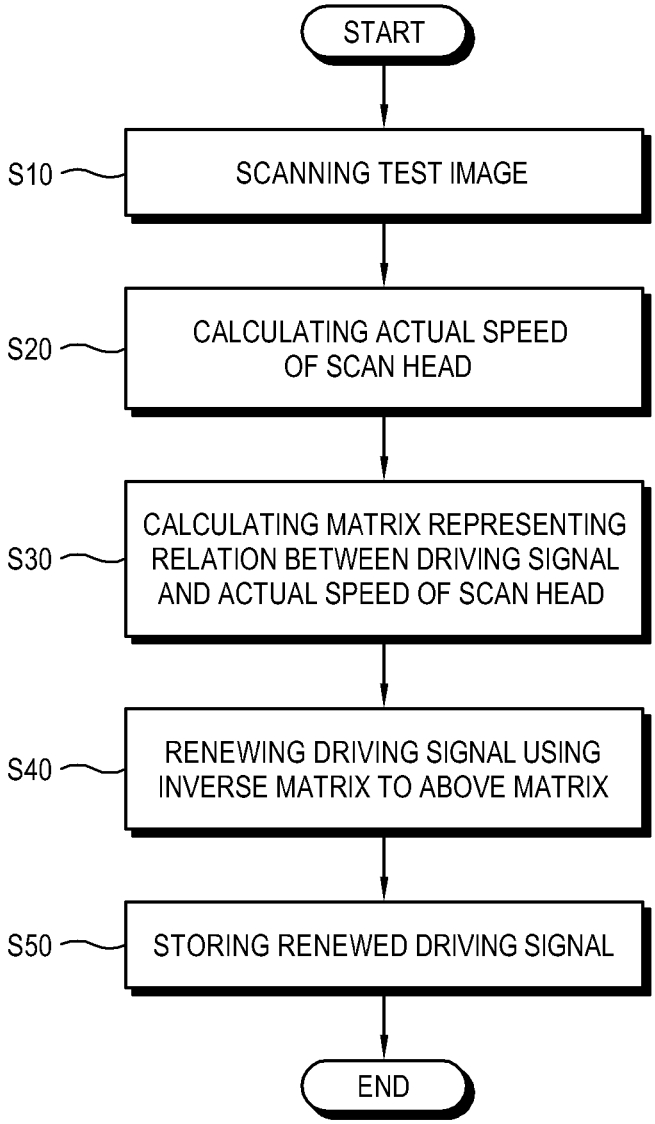
FIG. 3 is a flow diagram illustrating a motor control method of a scanner according to an exemplary embodiment of the present general inventive concept.

Referring to FIGS. 2 and 3, a motor control method of a scanner according to an exemplary embodiment of the present general inventive concept includes scanning a test image formed on the document 20 (operation S10), calculating an actual speed of the scan head 30 moved by the motor 41 using the scanned test image (operation S20), calculating a matrix representing the relation between the driving signal and the actual speed of the scan head 30 (operation S30), and renewing the driving signal using an inverse matrix to the calculated matrix (operation S40). Further, the method may include storing the renewed driving signal in the controller 45 (operation S50).

Figure 4:
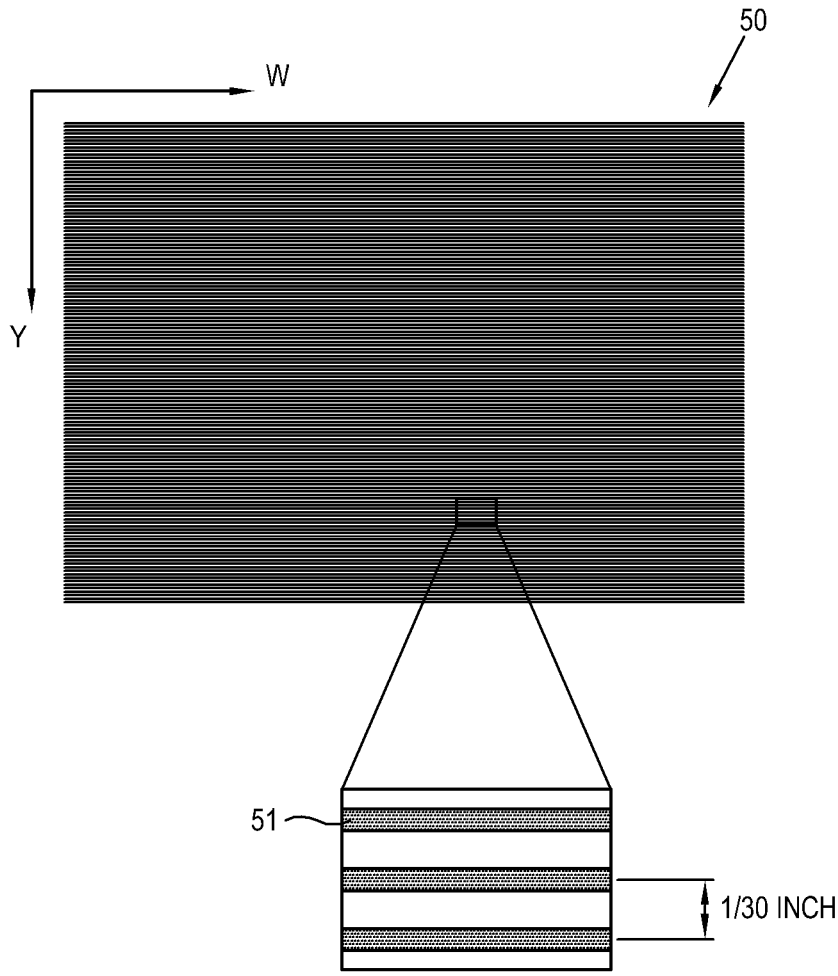
FIG. 4 schematically illustrates a test image including a plurality of patterns.

Referring to FIG. 4, the test image 50 includes a pattern part 51 formed along a direction 'w' perpendicular to a moving direction 'y' of the scan head 30. The pattern part 51 includes a plurality of linear patterns spaced from each other at a uniform interval in the direction 'y'. For example, the plurality of linear patterns may be spaced from each other so that an interval between centers of the neighboring patterns can be 1/30 inches. In this respect, the interval 1/30 inches represents an ideal interval between the linear patterns formed on the document.

According to the present exemplary embodiment, the test image 50 includes the plurality of linear patterns formed along the direction 'w' by way of example, but alternatively, may include other patterns such as square patterns, circular patterns, etc. so long as the patterns have a uniform interval.

The scanning the test image (operation S10) is performed through the scanner according to the present general inventive concept, in which color test images are separately read by means of the sensor unit 35 (FIG. 2).

Figure 5:
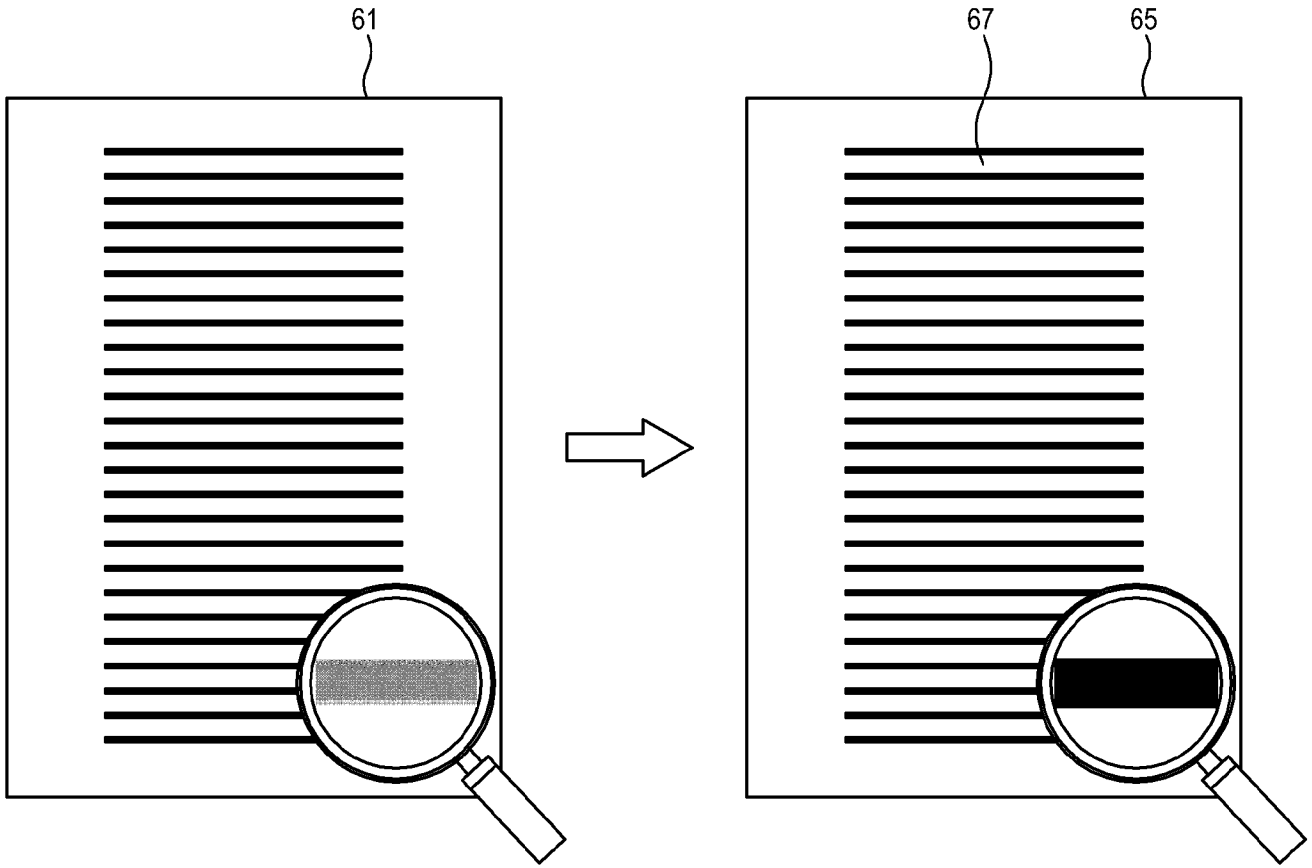
FIG. 5 schematically illustrates a scanned test image and a converted binary image.

Referring to FIG. 5, the scanned test image 61 may be converted into a binary image 65 represented by binary numbers 0 and 1 according to color pixel values. The binary image 65 ($I_{B(y,w)}$) may be expressed as the following equation 1:

$$I_{B(y,w)} = \begin{cases} 1: & \text{when } R(y,w) \le \Theta_R \text{ or } G(y,w) \le \Theta_G \text{ or } B(y,w) \le \Theta_B \\ 0: & \text{when } R(y,w) > \Theta_R \text{ and } G(y,w) > \Theta_G \text{ and } B(y,w) > \Theta_B \end{cases} \quad \text{Equation 1}$$

Here, y and w refer to pixel coordinates as shown in FIG. 4; R(y,w), G(y,w) and B(y,w) refer to pixel values representing gray scales of red, green and blue in coordinates (y,w); and θR, θG and θB refer to thresholds of red, green and blue. The thresholds θR, θG and θB may be selected as 90% of the maximum pixel values $R_{max}$, $G_{max}$ and $B_{max}$ of the respective colors red, green and blue. That is, $\theta_R$=0.9·Rmax, $\theta_G$=0.9·Gmax, and $\theta_B$=0.9·Bmax.

The selection of the thresholds in this exemplary embodiment is only an example, and the thresholds may be selected through other methods, such as a local area method or an adaptive method considering outside environments, as well as the whole area method in which the thresholds are selected on the basis of the maximum pixel values of the respective colors.

Referring to the above equation 1, the binary image ($I_{B(y,w)}$) is expressed as 0 when pixel values of the respective colors are above the thresholds, and as 1 when at least one of the pixel values of the respective colors is equal to or below the thresholds.

Figure 6:
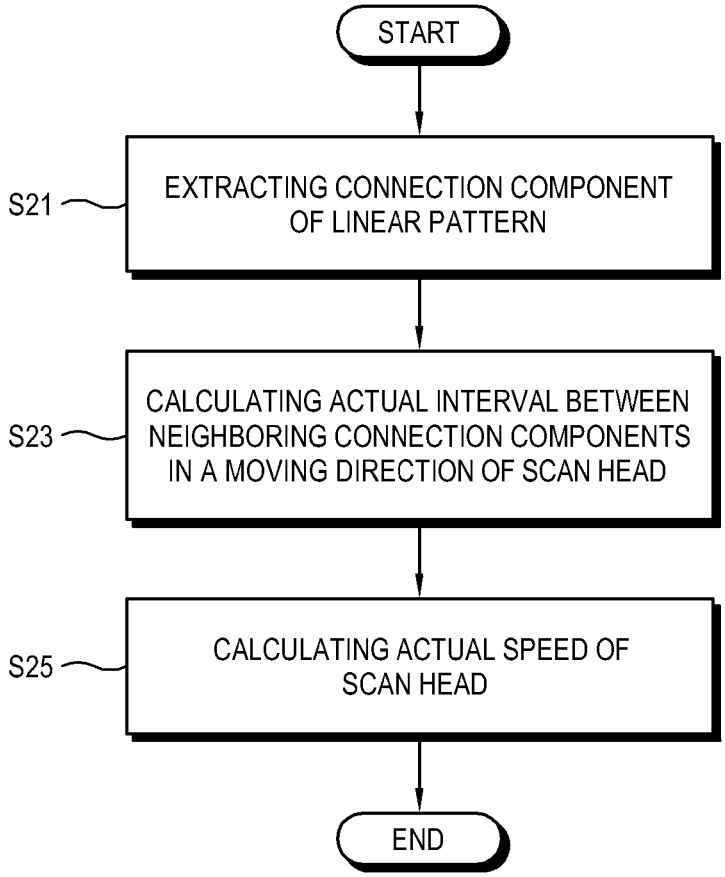
FIG. 6 is a flow diagram illustrating a process of calculating an actual speed of a scan head in FIG. 3.

Then, an actual speed of the scan head 30 moving by the motor is calculated using the binary image 65 of the scanned test image 61 (operation S20). Hereinafter, operation S20 will be described in more detail referring to FIG. 6 which illustrates operation S20 in detail.

First, connection components of a plurality of patterns 67 are extracted from the scanned test image 61 (operation S21). Each connection component is used to identify each of the plurality of patterns 67 constituting the test image 61. Each pattern 67 forms one connection component. In this exemplary embodiment, the connection component may be extracted by analyzing the binary image 65 expressed by the equation 1.

Then, an actual interval between the neighboring connection components in a moving direction 'y' of the scan head 30 is calculated (operation S23). The actual interval is calculated by generating a center profile of each connection component and calculating an interval between the center profiles of the respective connection components in the moving direction 'y' of the scan head 30.

As shown in FIG. 4, if an upper left corner is defined as an origin of the pixel coordinates (y,w), color center profiles of each pattern may be calculated by the following equation 2:

$$(Y_R, W_R) = \left( \frac{\sum_{R(y,w)\le\Theta_R} y\cdot[\Theta_R - R(y,w)]}{\sum_{R(y,w)\le\Theta_R} [\Theta_R - R(y,w)]}, \frac{\sum_{R(y,w)\le\Theta_R} w\cdot[\Theta_R - R(y,w)]}{\sum_{R(y,w)\le\Theta_R} [\Theta_R - R(y,w)]} \right) \quad \text{Equation 2}$$

-continued $$(Y_G, W_G) = \left( \frac{\sum_{G(y,w)\le\Theta_G} y\cdot[\Theta_G - G(y,w)]}{\sum_{G(y,w)\le\Theta_G}[\Theta_G - G(y,w)]}, \frac{\sum_{G(y,w)\le\Theta_G} w\cdot[\Theta_G - G(y,w)]}{\sum_{G(y,w)\le\Theta_G}[\Theta_G - G(y,w)]} \right)$$

$$(Y_B, W_B) = \left( \frac{\sum_{B(y,w)\le\Theta_B} y\cdot[\Theta_B - B(y,w)]}{\sum_{B(y,w)\le\Theta_B}[\Theta_B - B(y,w)]}, \frac{\sum_{B(y,w)\le\Theta_B} w\cdot[\Theta_B - B(y,w)]}{\sum_{B(y,w)\le\Theta_B}[\Theta_B - B(y,w)]} \right)$$

Here, $(Y_R,W_R)$, $(Y_G,W_G)$ and $(Y_B,W_B)$ refers to color center values of red, green and blue in the 'y' and 'w' coordinates, respectively, Referring to the equation 2, the color center values $(Y_R, W_R)$, $(Y_G,W_G)$ and $(Y_B,W_B)$ are calculated by summing center values obtained in the pixel coordinates (y,w) of the pattern when the color pixel value R(y,w), G(y,w) or B(y,w) is the same as or below the threshold $\theta_R$, $\theta_G$ or $\theta_B$. In this respect, if the calculated center values of the pattern contain an error, the method according to the present general inventive concept may further include correcting the error.

As described above, the actual interval between the neighboring connection components in the moving direction 'y' of the scan head 30 can be calculated based on the color center values of the respective patterns, and accordingly, an interval error between an ideal interval and the actual interval, between the connection components in the direction 'y' can be determined. Thus, the calculation accuracy can be enhanced compared with the conventional method of using the interval between the patterns.

Hereinbelow, an example of the interval error calculating method will be described referring to the color green. An interval $\Delta Y_G{}^m(i)$ between green center values of the neighboring patterns in the direction 'y' may be expressed as the following equation 3:

$$\Delta Y_G{}^m(i)=Y_G(i+1)Y_G(i) \qquad \text{Equation 3}$$

Here, $Y_G(i)$ refers to a green center value an i-th pattern; and i refers to a natural number representing a line index.

An ideal interval $\Delta Y_G{}^d$ between the green center values of the neighboring patterns in the direction 'y' may be expressed as the following equation 4:

$$\Delta Y_G{}^d=(1/\text{lpi})\times\text{dpi} \qquad \text{Equation 4}$$

Here, lpi (lines per inch) refers to the number of patterns per inch; and dpi (dots per inch) refers to scan resolution.

Accordingly, an interval error $e_{Y_G}(i)$ in the direction 'y' with respect to green may be calculated as a difference between an ideal interval $\Delta Y_G{}^d$ and an actual interval $\Delta Y_G{}^m(i)$ in the moving direction 'y' of the scan head 30.

Similarly, interval errors with respect to red and blue may be calculated, which may be expressed as the following equation 5:

$$e_{Y_{R,G,B}}(i)=\Delta Y_{R,G,B}{}^d-\Delta Y_{R,G,B}{}^m(i) \qquad \text{Equation 5}$$

Here, $e_{Y_{R,G,B}}(i)$ refers to a center value interval error in the direction 'y' with respect to red, green and blue.

At the final stage of operation S20, an actual speed v(i) of the scan head 30 is calculated according to the following equation 6 (operation S25):

$$\upsilon(i)=[\Delta Y_G{}^d/\Delta Y_G{}^m(i)]\times\upsilon_d \qquad \text{Equation 6}$$

Here, $v_d$ refers to an ideal speed of the scan head 30.

Referring to the equation 6, the actual speed v(i) is calculated using the ideal interval $\Delta Y_G{}^d$ and the real interval $\Delta Y_G{}^m(i)$, and the ideal speed $v_d$ of the scan head 30 calculated through the equations 3 and 4.

In operation S30, a matrix H representing the relation between a driving signal driving the motor and the calculated actual speed of the scan head 30 is calculated. The relation may be expressed as the following equation 7:

$$\upsilon_j=Hu_j \qquad \text{Equation 7}$$

Here, $u_j$ refers to a driving signal as a system input; $v_j$ refers to the actual speed of the scan head 30 as calculated through the equation 6; and j refers to a trial index.

The driving signal $u_j$, the actual speed $v_j$ of the scan head 30 and the ideal speed $v_d$ may be expressed as the following equation 8:

$$u_j=[u_j(0)\ \upsilon_j(1)\ldots u_j(N-1)],$$

$$\upsilon_j=[\upsilon_j(m)\ \upsilon_j(m+1)\ldots\upsilon_j(m+N-1],$$

$$\upsilon_d=[\upsilon_d(m)\ \upsilon_d(m+1)\ldots\upsilon_d(m+N-1)] \qquad \text{Equation 8}$$

Here, the speed vector $v_j$ represents the actual speed between the neighboring patterns from the first pattern to the last pattern as the number of steps of the stepping motor. The character m refers to a variable for considering a sample time interval between a first input which is not zero and a first output which is not zero, and may be selected into 1 without affecting generality.

It is preferable but not necessary that the matrix H has lower triangular Toeplitz Markov parameters, as shown in the following equation 9:

$$H=\begin{bmatrix} h_1 & 0 & 0 & \ldots & 0 \\ h_2 & h_1 & 0 & \ldots & 0 \\ h_3 & h_2 & h_1 & \ldots & 0 \\ \vdots & \vdots & \vdots & \ddots & \vdots \\ h_N & h_{N-1} & h_{N-2} & \ldots & h_1 \end{bmatrix} \qquad \text{Equation 9}$$

Here, $h_1$ has a value excluding zero so that an inverse matrix to the matrix H can exist.

According to the matrix H as constituted above, the respective parameters $h_1$ to $h_N$ may be obtained based on the given vectors $u_j$ and $v_j$ using a single trial convergent iterative learning control (ILC).

In operation S40, the driving signal is renewed using the inverse matrix $F(=H^{-1})$ to the calculated matrix H. That is, the renewed driving signal u* may be expressed as the following equation 10:

$$u^*=F^*\upsilon_d \qquad \text{Equation 10}$$

Here, $v_d$ refers to a vector for the ideal speed of the stepping motor.

The inverse matrix F has lower triangular Toeplitz Markov parameters similar to the matrix H.

Parameters $f_p$ existing in a diagonal direction among the parameters constituting the inverse matrix F may be obtained from the vectors u and v according to the following equation 11:

$$f_p = \begin{cases} \dfrac{u(1)}{v(1)}; & p = 1 \\ \dfrac{1}{v(1)}\left[u(p) - \sum_{q=1}^{p-1} f_q v(p-q+1)\right]; & p = 2, \ldots, N \end{cases} \quad \text{Equation 11}$$

As described above, according to the motor control method of the present exemplary embodiment, the parameters of the inverse matrix F necessary for renewing the driving signal can be calculated from information detected through a one-time test scan. Further, driving of the stepping motor can be controlled based on the renewed driving signal u*, to thereby correct the actual speed of the scan head 30.

Thus, in the scanner in which the stepping motor is controlled by the renewed driving signal, fluctuation generated in motor driving can be reduced, to thereby reduce the color registration error.

Figure 7A:
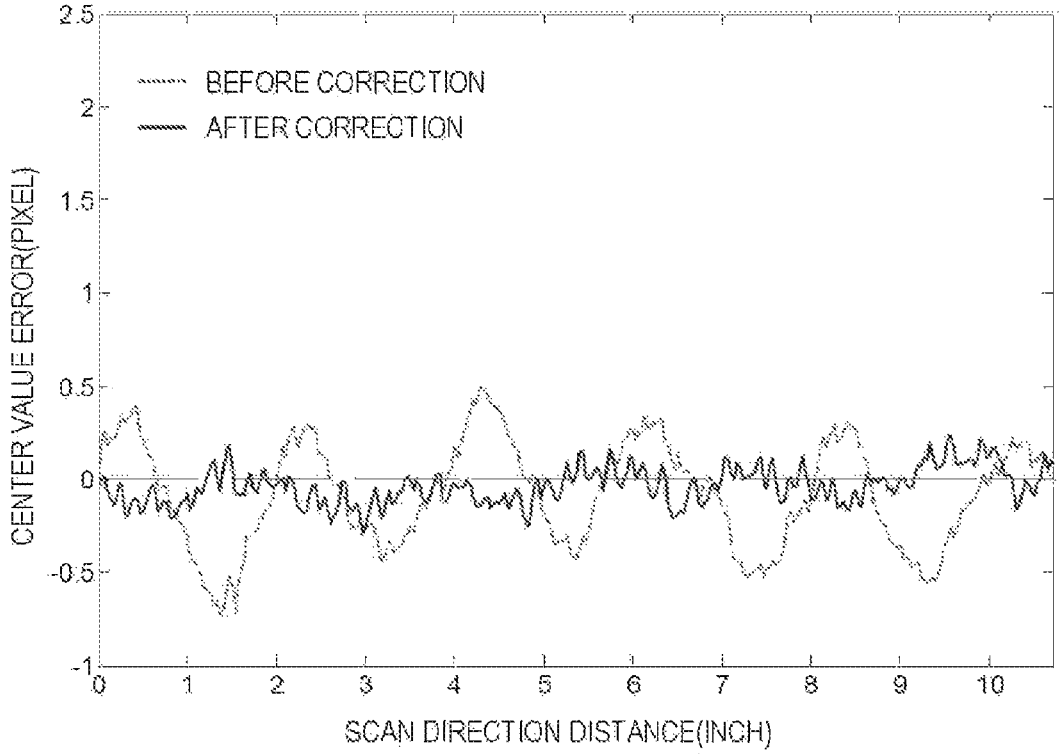
FIGS. 7A, 7B and 7C are graphs illustrating changes in center value errors with respect to red, green and blue according to a scan direction distance, before and after a driving signal is renewed.
Figure 7B:
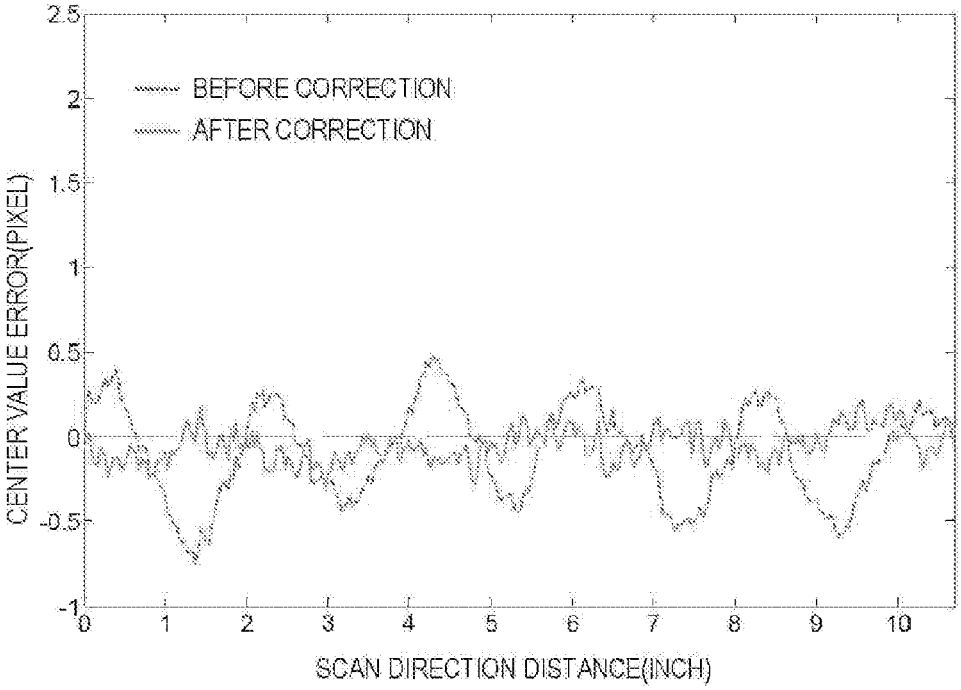
Figure 7C:
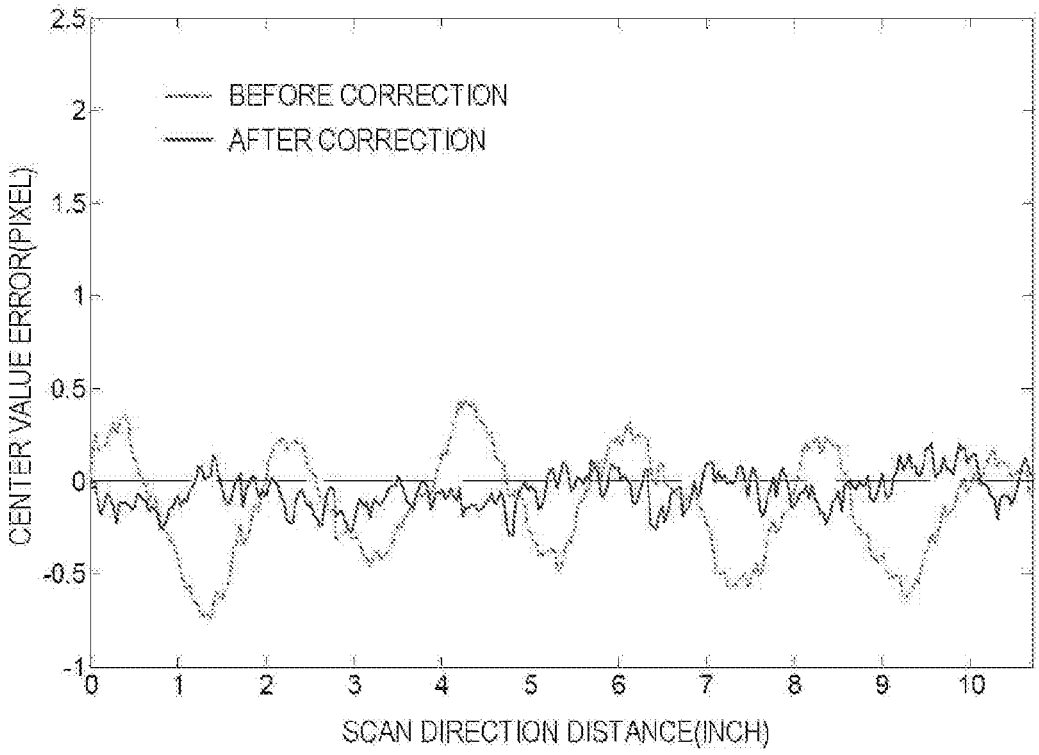

FIGS. 7A, 7B and 7C are graphs showing changes in color center value errors with respect to red, green and blue according to a scan direction distance, before and after the driving signal is renewed.

As shown, according to a center value error before renewal (or correction), a center value resulting from time optimization fluctuates approximately between +0.5 pixel and −0.7 pixel with respect to zero. On the other hand, according to the present exemplary embodiment, a color center value error fluctuates in the range of ±0.25 pixel by renewing the driving signal using initial driving time optimization and the ILC.

As described above, according to the scanner employing the motor control method according to the present general inventive concept, fluctuation generated in motor driving can be reduced, and thus, color registration error can be reduced.

Also, an image forming apparatus according to an exemplary embodiment of the present general inventive concept reads an image from a document and includes the scanner having the same configuration described with reference to FIGS. 2 to 7C, to read an image from a document, and a printing unit to print an image on a printing medium. The scanner has substantially the same configuration as the scanner according to the foregoing embodiments described with reference to FIGS. 2 to 7C. The printing unit prints an image on the supplied printing medium by a printing method such as an electrophotographic method, an inkjet method, a thermal transferring method, etc. The configuration and the operating mechanism of the printing unit are well known, and thus detailed descriptions thereof will be omitted. The image forming apparatus configured as described above has the advantage of reducing color registration error as well as fulfilling both scanning and printing functions as a single device.

Hereinafter, an image forming apparatus according to an exemplary embodiment of the present general inventive concept will be described.

Figure 8:
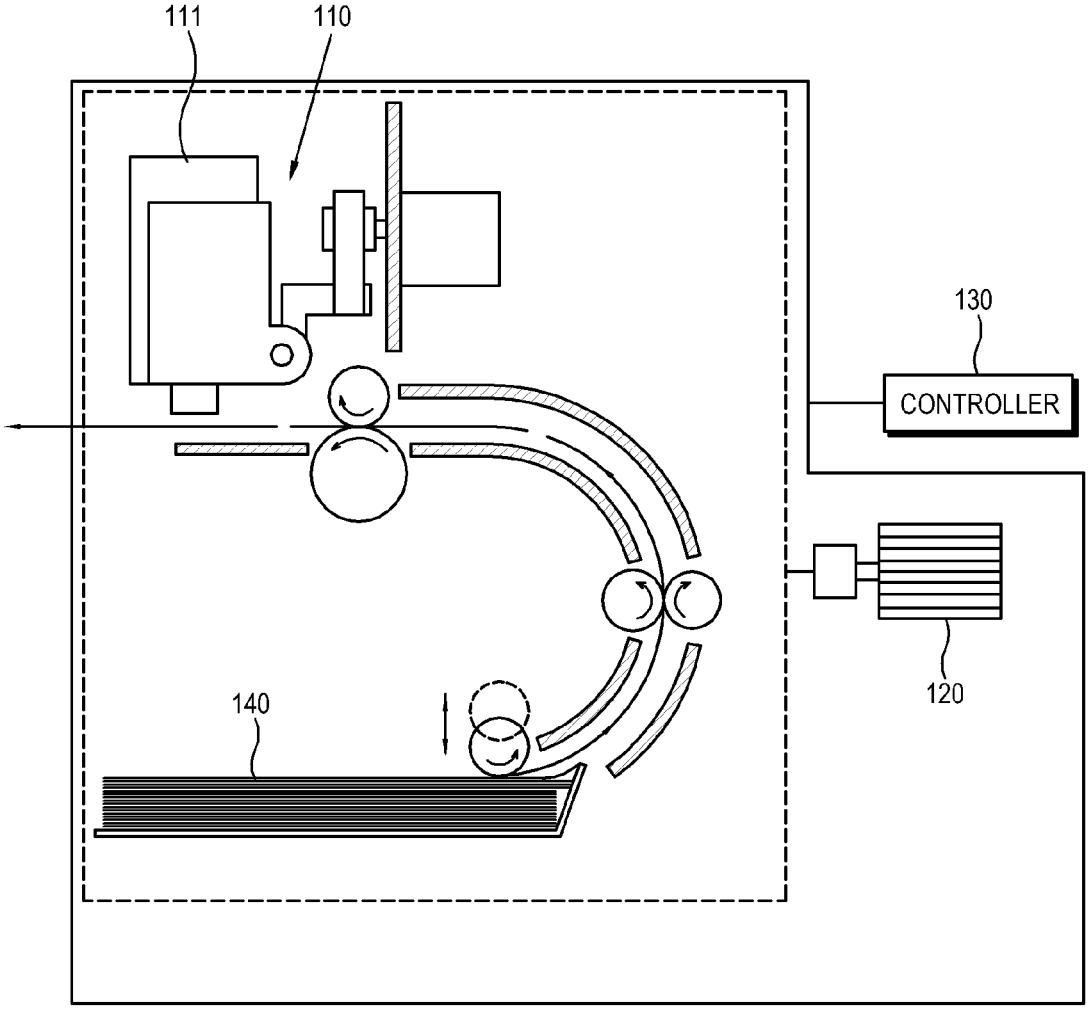
FIG. 8 illustrates an image forming apparatus according to an exemplary embodiment of the present general inventive concept.

Referring to FIG. 8, an image forming apparatus according to an exemplary embodiment of the present general inventive concept includes an inkjet head 110 provided with a plurality of color ink cartridges 111, a motor 120 for driving the inkjet head 110, and a controller 130 controlling the motor 120 by means of a driving signal.

The color ink cartridges 111 are spaced from each other. A full color image is formed on a printing medium by combining inks supplied from the color ink cartridges 111. The motor 120 is driven by a driving signal from the controller 130 and reciprocally moves the inkjet head 110. The motor 120 may be provided as a stepping motor rotating at a constant angle corresponding to the number of input pulses. Since the number of input pulses and a rotational angle of the motor 120 are proportional each other, the stepping motor can control positioning of an open loop.

The driving signal from the controller 130 drives the motor 120 to move the inkjet head 110, to thereby form a test image corresponding to printing data on a printing medium 140. The driving signal is renewed using the relation between an actual speed of the inkjet head 110 calculated using the test image and the driving signal for driving the motor 120, which will be described with reference to FIGS. 8 and 9.

Figure 9:
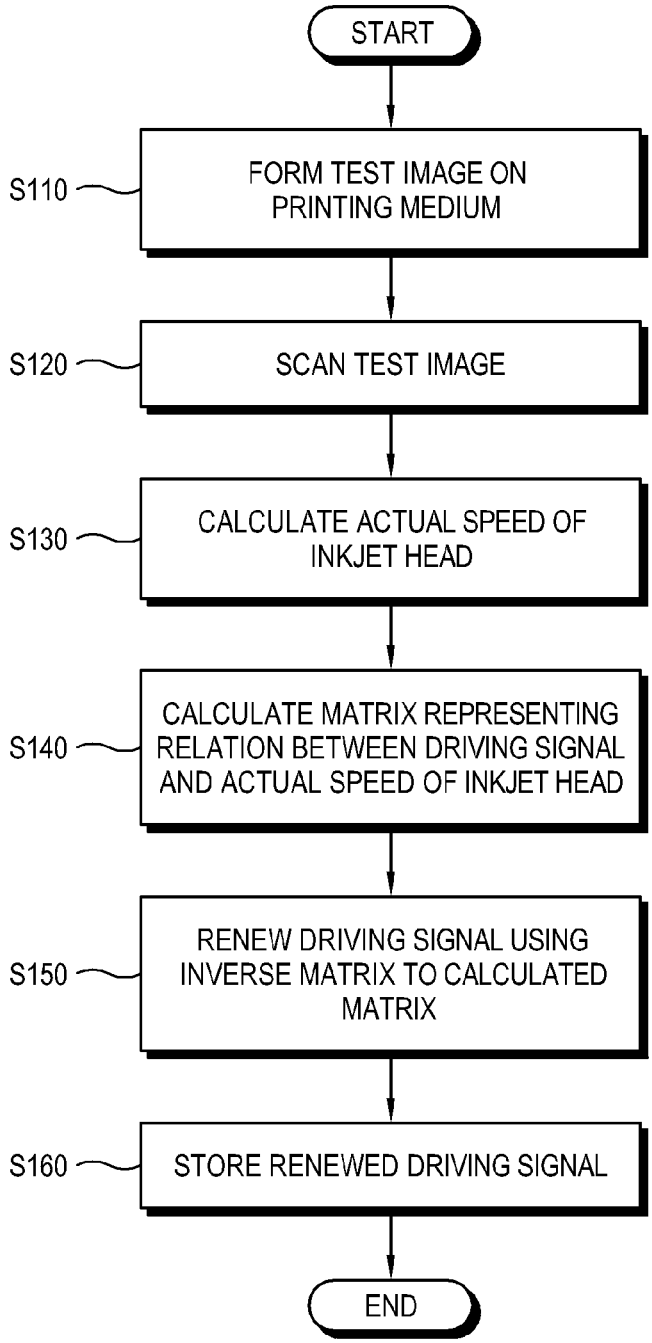
FIG. 9 is a flow diagram illustrating a motor control method of an image forming apparatus according to an exemplary embodiment of the present general inventive concept.

Referring to FIGS. 8 and 9, a motor control method of an image forming apparatus according to an exemplary embodiment of the present general inventive concept includes forming a test image on the printing medium 140 by driving the motor 120 to move the inkjet head 110 (operation S110), scanning the test image formed on the printing medium 140 using a scanner (operation S120), calculating an actual speed of the inkjet head 110 using the scanned test image (operation S130), calculating a matrix representing the relation between the driving signal and the actual speed of the inkjet head 110 (operation S140), and renewing the driving signal using an inverse matrix to the calculated matrix (operation S150). Further, the method according to the present embodiment may include storing the renewed driving signal in the controller 130 (operation S160).

Image data corresponding to the test image formed on the printing medium 140 may include a plurality of patterns arranged at a uniform interval. The plurality of patterns may be formed in a direction perpendicular to a moving direction of the inkjet head 110.

In this exemplary embodiment, an interval between the neighboring patterns formed on the printing medium 140 varies due to fluctuation caused in driving the motor 120.

Operations S120 to S150 are to renew the motor driving signal to reduce the fluctuation of the motor 120. Particularly, operation S120 is performed by using the scanner with motor driving control signal being renewed. Thus, an interval between the patterns in the scanned image read through operation S120 is similar to an interval between the patterns of the test image formed on the printing medium 140. Then, operations S130 to S150 are performed by using the scanned test image, to thereby read information on the motor driving signal of the image forming apparatus, and to thereby renew the motor driving signal.

Operations S130 to S150 are substantially the same as the above-described operations S20 to S40, and thus, repetitive description will be omitted for conciseness.

As described above, in the motor control method of the scanner according to the present general inventive concept, the driving signal is renewed using the matrix obtained from the relation between the driving signal and the interval error between the test patterns. Accordingly, in the scanner according to the present general inventive concept, fluctuation of the scan head generated in motor driving can be reduced, to thereby reduce the color registration error.

Further, in the image forming apparatus employing the motor control method according to the present general inventive concept, fluctuation generated in motor driving can be reduced, to thereby reduce an error of a drop position of an ink supplied from each color ink cartridge, to thereby reduce the color registration error and enhance image quality.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. A method for controlling a motor of an image forming apparatus, the method comprising:

scanning a test image formed on a document;

calculating an actual speed of a scan head moved by the motor using the scanned test image;

calculating a matrix representing a relation between a driving signal to drive the motor and the calculated actual speed of the scan head; and correcting the actual speed of the scan head by renewing the driving signal using an inverse matrix to the calculated matrix.

2. The method according to claim 1, wherein the test image comprises a plurality of patterns arranged at a uniform interval.

3. The method according to claim 2, wherein the calculating correcting the actual speed comprises:

extracting connection components of the respective patterns from the scanned test image; and calculating an actual interval between the neighboring connection components in a moving direction of the scan head, wherein the actual speed of the scan head is calculated by using an ideal interval and the actual interval between the connection components in the moving direction of the scan head and a predetermined ideal speed of the scan head.

4. The method according to claim 3, wherein the calculating the actual interval comprises:

generating a center profile of each connection component; and calculating an interval between the center profiles of the respective connection components in the moving direction of the scan head.

5. The method according to claim 1, wherein the matrix has lower triangular Toeplitz Markov parameters selected using single trial convergent iterative learning control.

6. The method according to claim 1, further comprising storing the renewed driving signal.

7. The method according to claim 1, wherein the motor comprises a stepping motor.

8. An image forming apparatus comprising:

a scan head provided to reciprocally move with respect to a document on which a test image is formed;

a motor to move the scan head to scan the test image; and a controller to control the motor with a driving signal, the motor being controlled by calculating an actual speed of the scan head moved by the motor using the scanned test image and calculating a matrix representing a relation between the driving signal and the calculated actual speed of the scan head, wherein the actual speed of the scan head is corrected by renewing the driving signal using an inverse matrix to the calculated matrix.

9. The image forming apparatus according to claim 8, wherein the test image comprises a plurality of patterns arranged at a uniform interval.

10. The image forming apparatus according to claim 9, wherein the actual speed of the scan head is calculated by extracting connection components of the respective patterns from the scanned test image, calculating an interval between center profiles of the respective connection components in a moving direction of the scan head to calculate an actual interval between the neighboring connection components in the moving direction of the scan head, and using an ideal interval and the actual interval between the connection components in the moving direction of the scan head and a predetermined ideal speed of the scan head.

11. The image forming apparatus according to claim 8, wherein the motor comprises a stepping motor.

12. The image forming apparatus according to claim 8, wherein the matrix has lower triangular Toeplitz Markov parameters selected using single trial convergent iterative learning control.

13. The image forming apparatus according to claim 8, further comprising:

a printing unit to print an image on a printing medium according to the renewed driving signal.

14. A method for controlling a motor of an image forming apparatus, the method comprising:

forming a test image corresponding to printing data on a printing medium by driving the motor to move an inkjet head having a plurality of ink cartridges;

scanning the test image formed on the printing medium;

calculating an actual speed of the inkjet head using the scanned test image;

calculating a matrix representing a relation between a driving signal to drive the motor and the calculated actual speed of the inkjet head; and correcting the actual speed of the inkjet head by renewing the driving signal using an inverse matrix to the calculated matrix.

15. The method according to claim 14, wherein the printing data comprises a plurality of patterns arranged at a uniform interval.

16. The method according to claim 15, wherein the correcting the actual speed comprises:

extracting connection components of the respective patterns from the scanned test images; and calculating an actual interval between the neighboring connection components in a moving direction of the inkjet head, wherein the actual speed of the inkjet head is calculated using an ideal interval and the actual interval between the connection components in the moving direction of the inkjet head and a predetermined ideal speed of the inkjet head.

17. The method according to claim 16, wherein the calculating the actual interval comprises:

generating a center profile of each connection component; and calculating an interval between the center profiles of the respective connection components in the moving direction of the inkjet head.

18. The method according to claim 14, wherein the matrix has lower triangular Toeplitz Markov parameters selected using single trial convergent iterative learning control.

19. The method according to claim 14, further comprising storing the renewed driving signal.

20. The method according to claim 14, wherein the motor comprises a stepping motor.

21. An image forming apparatus comprising:

an inkjet head having a plurality of ink cartridges;

a motor to move the inkjet head to form a test image corresponding to printing data on a printing medium; and a controller to control the motor with a driving signal, the motor being controlled by calculating an actual speed of the scan head moved by the motor using the formed test image and calculating a matrix representing a relation between the driving signal and the calculated actual speed of the inkjet head, wherein the actual speed of the inkjet head is corrected by renewing the driving signal using an inverse matrix to the calculated matrix.

22. The image forming apparatus according to claim 21, wherein the printing data comprises a plurality of patterns arranged at a uniform interval.

23. The image forming apparatus according to claim 22, wherein the actual speed of the inkjet head is calculated by:

extracting connection components of the respective patterns;

calculating an interval between center profiles of the respective connection components in a moving direction of the inkjet head to calculate an actual interval between the neighboring connection components in the moving direction of the inkjet head; and using an ideal interval and the actual interval between the connection components in the moving direction of the inkjet head, and a predetermined ideal speed of the inkjet head.

24. The image forming apparatus according to claim 21, wherein the matrix has lower triangular Toeplitz Markov parameters selected using single trial convergent iterative learning control.

25. The image forming apparatus according to claim 21, wherein the motor comprises a stepping motor.

* * * * *